United States Patent [19]

Yamazawa et al.

[11] Patent Number: 4,582,007

[45] Date of Patent: Apr. 15, 1986

[54] NEEDLE BAR TRANSFER DEVICE FOR MULTI-NEEDLE SEWING MACHINE

[75] Inventors: Masayuki Yamazawa, Kariya; Hiroshi Shinoda, Toyota, both of Japan

[73] Assignee: Aisin Seiki Kabushiki Kaisha, Japan

[21] Appl. No.: 706,995

[22] Filed: Feb. 28, 1985

[30] Foreign Application Priority Data

Feb. 29, 1984 [JP] Japan ..... 59-29877[U]

[51] Int. Cl.[4] ..... D05B 55/16

[52] U.S. Cl. ..... 112/163; 112/98; 112/221

[58] Field of Search ..... 112/98, 163, 221

[56] References Cited

U.S. PATENT DOCUMENTS 4,473,018 9/1984 Shimoda et al. ..... 112/163

4,474,124 10/1984 Yamazawa ..... 112/221 X

FOREIGN PATENT DOCUMENTS 2704855 8/1978 Fed. Rep. of Germany ..... 112/221

*Primary Examiner*—Werner H. Schroeder

*Assistant Examiner*—Andrew M. Falik

*Attorney, Agent, or Firm*—Sughrue, Mion, Zinn, Macpeak, and Seas

[57] ABSTRACT

In a needle bar transfer device for a multi-needle sewing machine, a depressing member is secured to a needle bar descending lever for aligning entire needle bars in an equal height at the time of transferring the needle bars, while a needle bar holding member is extended from the needle bar descending lever. Holding portions which are engageable with recessed portions provided at the upper ends of inoperative needle bars and an escape portion which receives an operative needle bar in an interference preventing manner are provided in the needle bar holding member.

3 Claims, 5 Drawing Figures

FIG. 1
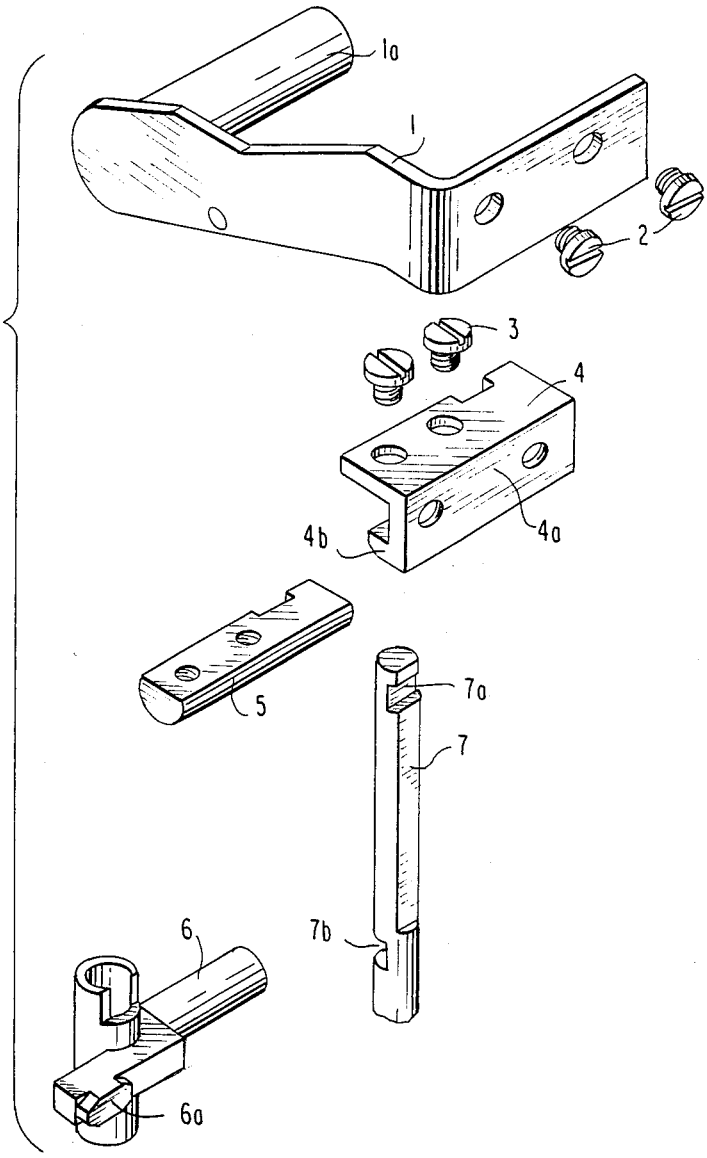
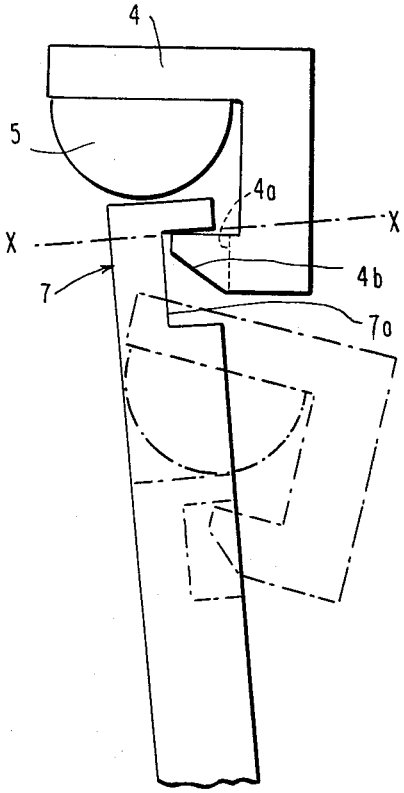
FIG. 4
FIG. 5
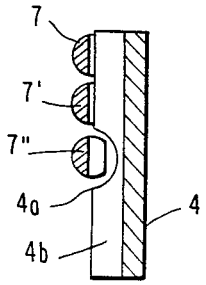

NEEDLE BAR TRANSFER DEVICE FOR MULTI-NEEDLE SEWING MACHINE

BACKGROUND OF THE INVENTION

1. Field of the Invention

This invention relates to a needle bar transfer device for a multi-needle sewing machine.

2. Description of Prior Art

In a sewing machine having a plurality of needle bars suppported by a common needle bar supporting arm, when one of the needle bars is driven by the main driving shaft of the machine, other needle bars are held in predetermined inoperative positions. For instance, in a sewing machine disclosed in U.S. Pat. No. 4,473,018, needle bars not driven by the main driving shaft are held in inoperative positions by pins each urged by a spring into a V-shaped groove formed in upper end of the needle bar. Spring forces of a sufficient strength are required for holding the needle bars assuringly in the inoperative positions. However, when the spring forces are selected to be excessive, a heavy depressing force must be applied at the time of transferring a needle bar for disengaging the needle bar from the spring biased pin. Furthermore, yielding of the springs makes it impossible to hold the needle bars in their inoperative positions, rendering the sewing machine to be inoperative.

Applicants' prior U.S. Pat. No. 4,474,124, granted Oct. 2, 1984, discloses a multiple needle sewing machine which utilizes a common flexible plate having three pawl members adapted to resiliently engage grooves adjacent the tops of respective needle bars. A spring is provided for normally biasing the plate upwardly to locate the unused needle bar in an elevated noninterfering position. Once again the resilient force of the flexible member presents a drawback in engaging and disengaging the individual needle bars form the holding member.

SUMMARY OF THE INVENTION

An object of the present invention is to provide a needle bar transfer device for a multi-needle sewing machine wherein the above described difficulties of the conventional devices can be substantially eliminated.

Another object of the invention is to provide a needle bar transfer device for a multi-needle sewing machine wherein inoperative needle bars are held in their positions without utilizing spring forces.

These and other objects of the invention can be achieved by a needle bar transfer device for a multi-needle sewing machine wherein holding means are provided to extend from a neelde bar descending lever including means for aligning the needle bars at an equal height, and engaging portions engaging the grooves of the inoperative needle bars and an escape portion in which the operative needle bar is freely movable are provided in the holding means.

With the above described construction, the inoperative needle bars are brought upward in accordance with the upward movement of the needle bar descending lever, and held in the inoperative positions without requiring the spring forces.

BRIEF DESCRIPTION OF THE DRAWINGS

In the accompanying drawings:

FIG. 1 is an exploded perspective view of a preferred embodiment of the present invention;

FIG. 4 is a diagram useful for the explanation of a needle bar transfer operation of the embodiment; and FIG. 5 is a sectional view along the line X—X in FIG. 4.

DESCRIPTION OF THE PREFERRED EMBODIMENT

Figure 3:
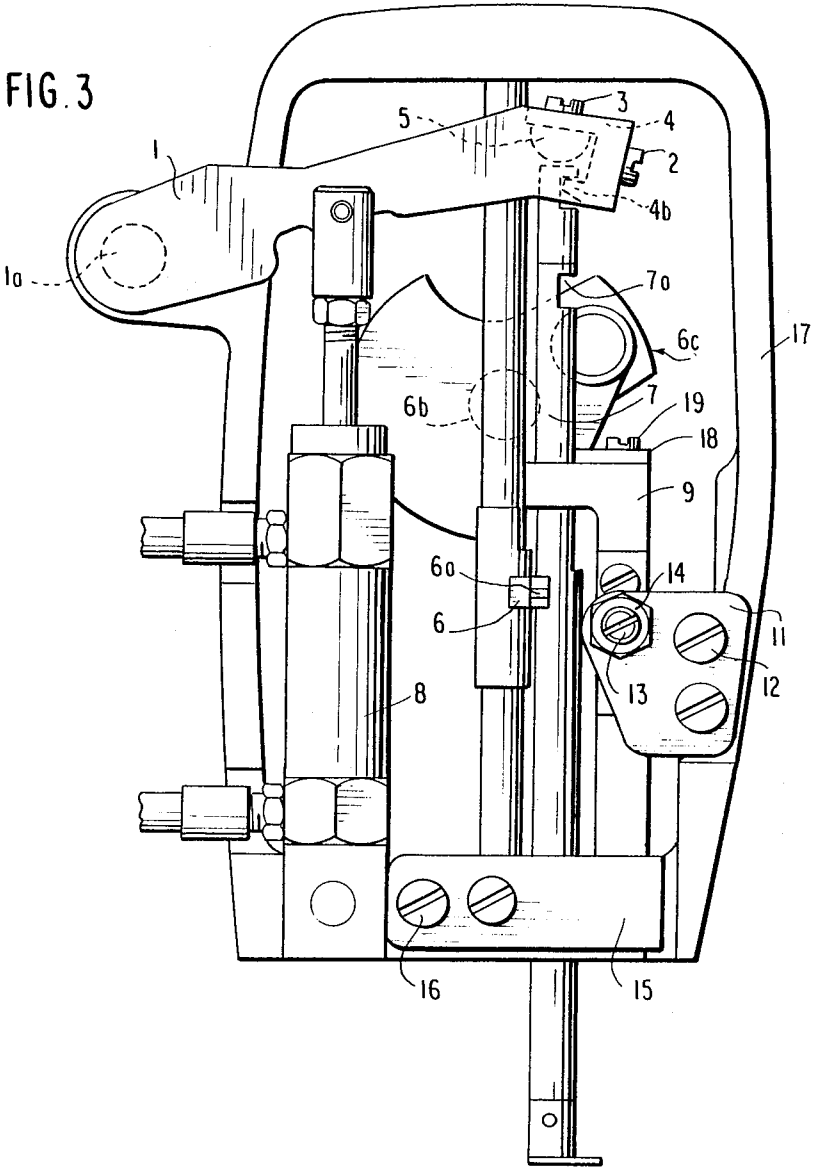
FIG. 3 is an elevational front view of the embodiment.
Figure 2:
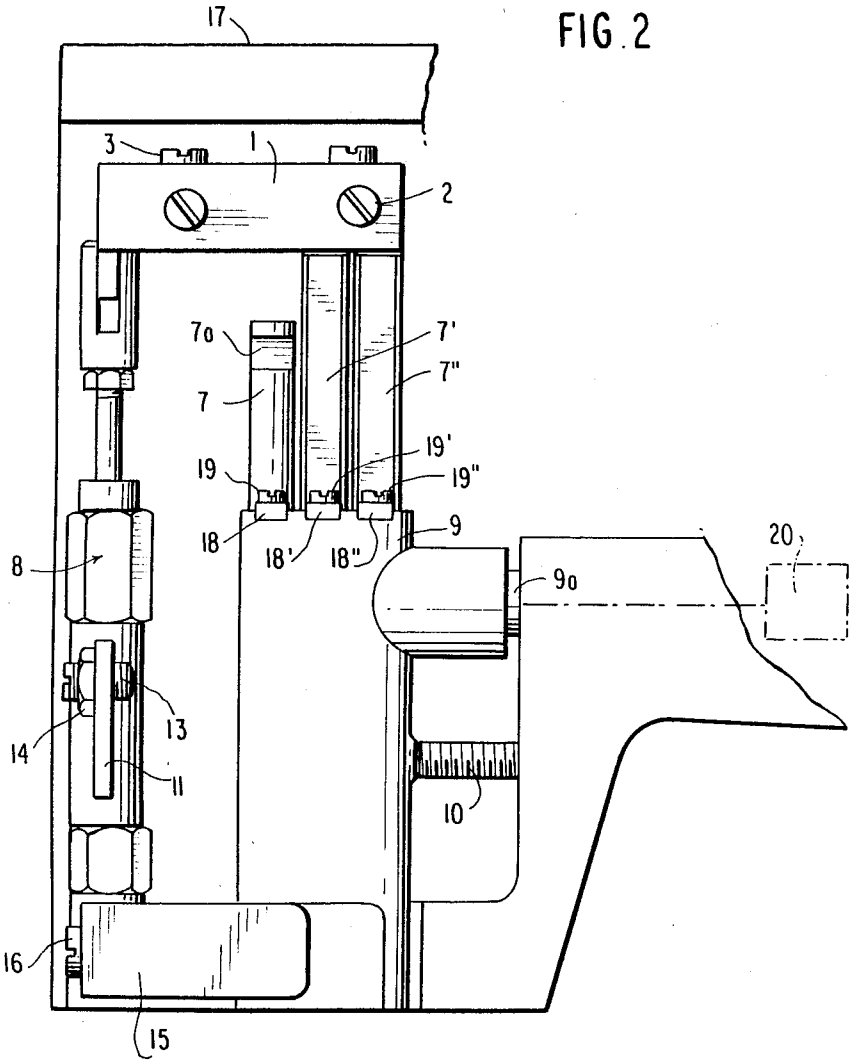
FIG. 2 is an elevational side view of the embodiment.

A preferred embodiment of the present invention will now be described in detail with reference to FIGS. 1 through 5.

A plurality of needle bars 7, 7' and 7'' are supported by a needle bar supporting arm 9. The rotation of the needle bars 7, 7' and 7'' is restricted by rotation restricting plates 18, 18' and 18'' secured to the needle bar supporting arm 9 by means of screws 19, 19' and 19'', respectively. A guide plate 15 is provided to restrict rotation of the needle bar supporting arm 9 around a shaft portion 9*a* thereof.

A needle bar transfer mechanism 20 is operatively connected with the shaft portion 9*a* of the needle bar supporting arm 9. By manipulating a dial or lever (not shown) of the needle bar transfer mechanism 20, the needle bar supporting arm 9 is shifted transversely to the sewing direction of the sewing machine. The aforementioned guide plate 15 is secured to an arm 17 of the sewing machine by means of a screw 16.

The transverse movement of the needle bar supporting arm 9 is restricted by a stopper screw 10 and another stopper screw 13 which is secured by a nut 14 to a stopper securing plate 11. The stopper securing plate 11 is in turn secured to the arm 17 of the sewing machine by means of screws 12.

A needle bar holding member 4 of a channel shape is secured to a needle bar descending lever 1 by means of screws 2. A needle bar depressing member 5 of a semicircular cross section is secured to the recessed portion of the needle bar holding member 4 by means of screws 3. The needle bar descending lever 1 is swung around a shaft portion 1*a* thereof together with the needle bar holding member 4 and the needle bar depressing member 5 under the action of an air cylinder 8 coupled to an intermediate portion of the needle bar descending lever 1.

Each of the needle bars 7, 7' and 7'' is provided, at an upper end thereof, with a recessed portion 7*a*, and at an intermediate portion thereof, with another recessed portion 7*b*.

When it is desired to transfer needle bars 7, 7' and 7'', a switch (not shown) is manipulated to operate air cylinder 8 such that the needle bar descending lever 1 is thereby rotated clockwisely around the shaft portion 1*a* of the lever 1. The rotation of the needle bar descending lever 1 causes the needle bar depressing member 5 to push needle bars so far held in the inoperative positions downwardly until it is brought into contact with the upper end of the presently operating needle bar (as shown by dash lines in FIG. 4), so that all the needle bars 7, 7' and 7'' are aligned at an equal height. Then the dial (not shown) is manipulated to shift the needle bar supporting arm 9 transversely together with the needle bars 7, 7' and 7''. In this case, the recessed portions 7*a* and 7*b* of the needle bars 7, 7' and 7'' are also held in equal heights, respectively. As a consequence, the engagement of a projection or engaging means 6a of a crank-rod end 6 which is coupled to the main driving shaft 6b by a crank mechanism 6c is transferred from the recessed portion 7b of the needle bar previously operated to the recessed portion 7b of the newly selected needle bar. At the same time, the recessed portion 7a of the needle bar previously operated is shifted from an escape portion 4a of the needle bar holding member 4 to be brought into engagement with an L-shaped projecting portion 4b of the holding member 4, while the recessed portion 7a of the newly selected needle bar, which has been engaged with the L-shaped projecting portion 4b of the holding member 4 is now brought into alignment with the escape portion 4a to be disengaged from the L-shaped projecting portion 4b of the needle bar holding member 4.

When the switch (not shown) is manipulated again to operate the air cylinder 8 in the reverse direction, the needle bar descending lever 1 is rotated in the counter-clockwise direction. The restriction of the counter-clockwise movement of the needle bar descending lever 1 is imparted by the abutment of the lever 1 against the arm 17 of the sewing machine. As a result of the counter-clockwise rotation of the needle bar descending lever 1, all the needle bars having upper end recesses 7a engaging with the L-shaped projecting portion 4b of the needle bar holding member 4, that is, the inoperative needle bars are brought into waiting positions provided upward.

What is claimed is:

1. A needle bar transfer device for a multi-needle sewing machine comprising:

a main driving shaft;

a plurality of needle bars each provided with a recessed portion at an upper end thereof;

a needle bar supporting arm supporting said needle bars to be movable vertically; engaging means operatively coupled with said main driving shaft so as to be engageable with one of said needle bars;

a needle bar descending lever pivotally supported by a machine arm to be swingable between an upper position and a lower position;

means for driving said needle bar descending lever between said upper ordinary position and said lower needle bar transfer position;

needle bar holding means extended from said needle bar descending lever so as to provide holding portions that engage said recessed portions of needle bars not engaging with said engaging means and an escape portion located on said holding portions that prevents interference to the movement of a needle bar engaging with said engaging means, thereby to ordinarily maintain the needle bars not engaging with said engaging means in their inoperative positions;

depressing means provided in connection with said needle bar descending lever such that when said needle bar descending lever is moved downward, said depressing means depresses the upper ends of needle bars held in the inoperative positions to align the needle bars at a height equal to that of a needle bar engaging with said engaging means; and means for shifting said needle bar supporting arm, after the alignment of the entire needle bars, in a direction transverse to the sewing direction of the sewing machine.

2. A needle bar transfer device as set forth in claim 1 wherein said depressing means comprises a bar-shaped member of a semicircular cross section having a curved surface that depresses the upper ends of said needle bars.

3. A needle bar transfer device as set forth in claim 1 wherein said holding portions of said needle bar holding means are provided on both sides of said escape portion.

* * * * *